United States Patent [19]

Geisler et al.

[11] 4,017,342

[45] Apr. 12, 1977

[54] METHOD FOR IMPROVING METAL COMBUSTION IN SOLID ROCKET PROPELLANTS

[75] Inventors: Robert L. Geisler, Tehachapi, Calif.; Arnold M. Crelier, Colorado Springs, Colo.; Francisco Q. Roberto, Lancaster, Calif.

[73] Assignee: The United States of America as represented by the Secretary of the Air Force, Washington, D.C.

[22] Filed: Apr. 5, 1976

[21] Appl. No.: 674,020

[52] U.S. Cl. ..... 149/5; 427/216

[51] Int. Cl.[2] ..... C06B 45/30

[58] Field of Search ..... 149/5; 427/213, 216

[56] References Cited

UNITED STATES PATENTS

| | | | |
|---|---|---|---|
| 3,017,264 | 1/1962 | Karlowicz | 149/5 X |
| 3,153,584 | 10/1964 | Goon | 427/216 X |
| 3,353,937 | 11/1967 | Ford et al. | 427/216 X |
| 3,381,473 | 5/1968 | Kuehl | 149/5 X |
| 3,704,184 | 11/1972 | Kuehl et al. | 149/5 X |

*Primary Examiner*—Edward A. Miller

*Attorney, Agent, or Firm*—Joseph E. Rusz; William J. O'Brien

[57] ABSTRACT

A method for improving the ballistic properties of aluminum powder based rocket propellants by treating the aluminum powder with hydrogen fluoride gas prior to its incorporation into a propellant formulation.

3 Claims, 4 Drawing Figures

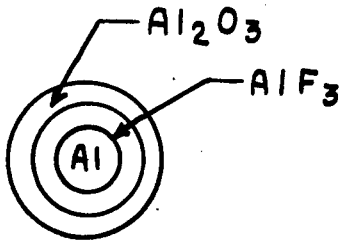

METHOD FOR IMPROVING METAL COMBUSTION IN SOLID ROCKET PROPELLANTS

STATEMENT OF GOVERNMENT INTEREST

The invention described herein may be manufactured and used by or for the government for governmental purposes without the payment of any royalty thereon.

BACKGROUND OF THE INVENTION

This invention relates to a method for treating aluminum metal powder. In a more particular aspect, this invention concerns itself with a facile method of modifying aluminum metal powders in order to improve their combustion efficiency as a fuel for solid rocket propellants.

The increased utilization of rockets, missiles and other propulsion type devices has generated a considerable research effort in an attempt to improve propellant combustion efficiency. It has been suggested for example, that the burn rate may be increased by using non-energetic additives such as ferric oxide, ferrocenes and metal fluorides; or, by using a finer oxidizer blend. However, in the former case, a reduction in specific impulse due to the non-energetic additive is incurred and the latter approach may make processing more difficult.

With this invention, however, it has been found that reacting aluminum metal powders with gaseous hydrogen fluoride overcomes the drawbacks encountered when using untreated aluminum powders as the fuel constituent in solid rocket propellants.

SUMMARY OF THE INVENTION

In accordance with this invention, it has been found that the burn rate of solid rocket propellants utilizing aluminum metal powders as a fuel constituent can be significantly increased by first treating the aluminum powder with gaseous hydrogen fluoride. The modified aluminum powder is prepared by reacting the powder with dry gaseous hydrogen fluoride. An exothermic reaction occurs immediately which etches the metal at boundaries formed during the production process of the fine powder. At the boundaries, the reaction replaces the strong oxide coating having a melting point of 2045° C with a weaker fluoride coating which sublimes at 1291° C at 760 mm pressure. When the reaction is completed, the modified aluminum powder is dried in the oven prior to use in a propellant formulation as the fuel ingredient.

Accordingly, the primary object of this invention is to improve the combustion properties of aluminum powder in solid rocket propellant formulations.

Another object of this invention is to provide a method for increasing the burn rate of solid rocket propellants which utilize aluminum powder as a fuel ingredient.

Still another object of this invention is to provide a method for decreasing the ignition delay time of an aluminum metal fuel on a solid propellant's burning surface.

A further object of this invention is to provide a method for decreasing the size of aluminum agglomerates on a solid propellant's burning surface.

Still a further object of this invention is to provide a method which decreases the total burn time necessary to completely combust an aluminum fuel to its oxide.

The above and still further objects and advantages of the present invention will become more readily apparent upon consideration of the following detailed description thereof when taken in conjunction with the accompanying drawing.

DESCRIPTION OF THE DRAWING

FIG. 1 represents a schematic illustration of untreated aluminum powder; while

DESCRIPTION OF THE PREFERRED EMBODIMENT

Figure 1:
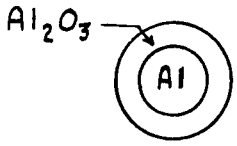

With the above-mentioned and other objects in mind, the present invention contemplates a method for improving the ballistic properties of aluminum metal powders used as the fuel constituent of propellant formulations. In essence, the invention is predicated upon the discovery that gaseous hydrogen fluoride can be used to react with aluminum powder and replace the normal aluminum oxide coating on the surface of the aluminum powder with a fluoride. The reaction is exothermic and etchs the aluminum metal at boundaries formed during the production process used for producing the fine powders.

The specially-treated aluminum powder, found to dramatically improve combustion characteristics in solid propellant formulations, has a demonstrated ability to increase propellant burn rate in many AP/HTPB systems. Especially when the burn rate is already low, where large agglomerates are present, agglomerate residence time is short.

It reduces the burn rate slope in some AP/HTPB systems and increases by a factor of two the time elapsed between the growth of an agglomerate to its final size and the liftoff of the agglomerate into the vapor phase. Finally, it produces a large decrease in agglomerate size in some double base formulations (as observed in combustion bomb movies), and produces a 1% motor Isp efficiency increase in low burning rate ($r_b$) compositions as observed in 15 pound BATES motors.

The modified aluminum powder of this invention was discovered while seeking a means to improve propellant combustion efficiency that would be more economical than usage of NE-containing binders. For example, lithium fluoride has been examined as an additive to propellants, but it was found that it produced no increase in combustion efficiency. Several metal fluorides have also been examined and it has been observed that $CuF_2$, $FeF_3$, and $CrF_3$ elevate the burn rate and depress the burn rate slope; while $MgF_2$ increase both the burn rate and the burn rate slope. $PbF_2$, LiF, and $AlF_3$ depress the burn rate and elevate the burn rate slope, while $ZnF_2$ produced no measurable effect upon either the burn rate or pressure exponent.

The reaction between LiF and $NH_4ClO_4$ has been studied and was suggested that $LiCLO_4$ was formed as an initial product. A possible reaction would be $$LiF + NH_4ClO_4 \rightarrow LiClO_4 + NH_3 + HF \quad (1)$$

The hydrogen fluoride can then react with either the $Al_2O_3$or with the Al and the LiF can also react directly with the aluminum to yield $AlF_3$. Furthermore, the $AlF_3$ can react with excess aluminum at low temperatures to give the volatile aluminum monofluoride $$AlF_3 + 2\ Al \rightarrow 3\ AlF \quad (2)$$

However, the limiting factor in most of these reactions is the ability of a gaseous reactant to diffuse through the $Al_2O_3$ coating which protects the aluminum powder. It was believed therefore, that if only the fluoride source could be intimate contact with the aluminum before the aluminum powder was incorporated in a propellant, then perhaps combustion processes might be improved since the fluoride would no longer have to diffuse through the porous (but tenacious) oxide layer in order to react with the aluminum.

Consequently, as-received, aluminum powder was treated with anhydrous HF at 25° C. Several hundred grams of powder were exposed to flowing HF gas for 30 minutes and an exotherm of approximately 15° C indicated that some reaction was taking place. When the first propellant formulation using the treated aluminum powder of this invention was evaluated in strand tests, it produced a 25% burn rate increase over the baseline formulation at 1000 psig (0.52 in/sec vs. 0.68 in/sec).

Examination of both as-received aluminum powder and the treated aluminum powders with a Coates and Weltner Model 100 (with the lens modification) showed no discernible difference between the two powders regardless of particle size on treatment level. Since the HF was unquestionably having some effect upon the aluminum powder, it was decided to study a more uniform aluminum surface such as the one offered by aluminum foil. With a very uniform surface, it was thought that even minor changes brought about by reaction with the HF could be noted.

A dramatic change in the foil surface was seen upon treatment with HF. The shiny side of untreated foil is seen to be quite smooth with many parallel ridges which were created. during the production process by the rolling process. The same side of the foil after HF treatment, however, contains numerous deep pits and cracks. The dull side of the same foil section exhibited little or no evidence of attack by the HF and was actually more representative of the aluminum powder. it was decided to pursue study of the shiny side of the foil to find out as much as possible about the mechanism of the reaction between the HF and the aluminum surface.

Originally, the cracks seen on the treated foil surface were thought to be cracks in the oxide layer alone which had perhaps been caused by a direct reaction between the $Al_2O_3$ and the HF gas. However, for two reasons this theory was discounted. First, careful measurement of the depth of the dracks showed them to be far too deep (i.e., 2–3 microns) to be cracks in the oxide layer alone (approximately 50 A). Secondly, when $Al_2O_3$ powder (30 micron) was treated at the 0.15% conversion level (i.e., if all of the HF reacted with the aluminum, then 0.15% of the aluminum by weight would have been converted to $AlF_3$) and examined in the scanning electron microscope, no cracking or other type of surface modification could be observed. Additionally, after the powder was heated overnight at 220° C (a standard processing step taken with all powders before they are used in a propellant), thermal gravimetric analysis to 600° C indicated that no HF was trapped within the alumina. Also, mass spectral analysis at temperatures up to 400° C and at a vacuum of $2 \times 10^{-7}$ Torr detected no evolution of fluorine-containing compounds. Based upon this data, the exotherm which results from the reaction of HF gas with aluminum powder is attributed exclusively to the reaction between the HF and the pure aluminum which lies beneath the protective (and apparently porous) $Al_2O_3$ Layer.

The pitting seen in many locations on the surface of the treated foil is the result of an especially vigorous stress corrosiion reaction which has taken place at the location of impurity sites (e.g., Si, Cu, or Fe). The white appearance of the cracked coating around the pits is due to a phenomenon in scanning electron microscopy known as "charging" and is indicative of an area which is unable to dissipate incident electrons to the metallic substrate rapidly enough to prevent a buildup of electrons. The existence of charging suggests that there has actually been a physical separation between the cracked, upper layer and the aluminum substrate which lies beneath.

Although the $Al_2O_3$ protective layer tenaciously adheres to the pure aluminum which lies beneath it, there is evidence that the oxide layer is porous enough to permit cretain molecules to diffuse through it and react with the pure aluminum.

Experiments were conducted to confirm the porosity of the $Al_2O_3$ coating found on aluminum. A scanning electron microscope (S.E.M.) has the ability to examine (i.e., "MAP") a surface for the presence of a specific element. Fluorine, however, is just on the edge of the instrument's detection ability. Therefore, a portion of aluminum foil was treated with HCl gas since chlorine is easily detected by the S.E.M. and further elucidation of the mechanism of this invention would be possible. It was found that the attack of the HCl gas was quite sporadic and produced neither the cracking nor the pitting that was so common with HF treatment. Examination by S.E.M. for chlorine showed white areas to be chlorine-rich, presumably indicating the formation of $AlCl_3$ at those locations where the $Al_2O_3$ layer was the thinnest. Since HCl is a larger molecule than HF, it would appear that the reaction was impeded by the inability of the HCl molecule to successfully diffuse through $Al_2O_3$ lattice.

In another experiment, aluminum foil was treated with a $Cu(Cl)_2$ solution and the same type of reaction took place. Small areas which were found to be copper-rich were indicative of non-uniform oxide thickness.

Ion-scattering spectrometry indicated that a fluoride-containing layer did indeed exist on the surface of the treated foil Argon ion sputtering of the treated foil revealed that the fluoride-containing layer was located beneath the $Al_2O_3$ coating and above the pure alumium.

X-ray images of a portion of the highly-cracked foil surface brought out several points. First, aluminum is present in higher concentrations in the depths of the cracks themselves than in the plateaus of the uncracked coating. Next, the fluoride was found to be present primarily in the coating material. These two obsevations lead to a suggested mechanism such as the one shown in FIGS. 2, 3 and 4 for an explanation of the reaction between HF gas and aluminum powder.

FIG. 1 shows an untreated aluminum powder particle with a coating of aluminum oxide.

Figure 2:
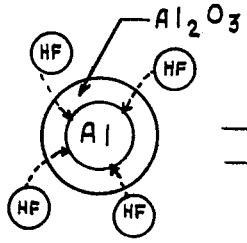
FIG. 2, 3 and 4 represent schematic illustrations which depict the effect of the reaction between hydrogen fluoride gas.
Figure 3:
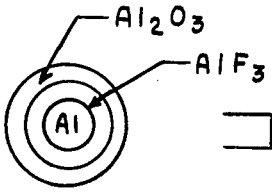
Figure 4:
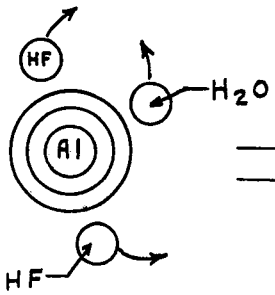

The first step in the proposed mechanism occurs when the HP gas diffuses through the porous $Al_2O_3$ coating and starts reacting with the pure aluminum underneath as shown in FIG. 2. Heat is evolved, physical stresses start building up, and soon a "sandwich" situation exists with $Al_2O_3$ exiss on the particle surface, $AlF_3$ (and perhaps also $AlF_3 \cdot 3H_2O$ and $AlF_3$ 1 AlF) beneath the oxide, and then, finally, pure aluminum in the particle's center as shown in FIGS. 3 and 4. The the thermal and physical stresses which arise when the $AlF_3$ layer is formed are sufficient to cause the $Al_2O_3$ and $AlF_3$ layers to yield together and deep cracks are created throughout the upper two layers. At the bottoms of the cracks, pure aluminum is revealed and the freshly exposed aluminum is soon recovered with a thin oxide layer.

It should be pointed out that the cracking observed on the shiny side of aluminum foil is much more pronounced than it is on the dull side. This is a result of the fact that during the foil production process may "roller fracture sites" are created as the "hills and valleys" present on the dull side are flattened out. Therefore, the shiny side is effectively prestressed, more porous, and consequently, more susceptible to attack by the process of the invention.

The next surface examination technique employed was that of Auger spectroscopy. Examination of an untreated foil sample showed that a thin layer (100 A) of a surface carbon contaminant was present and that an $Al_2O_3$ layer about 75–100 A thick was located beneath the carbon layer. In the treated foil sample, the carbon layer was still present as was the $Al_2O_3$ layer, but the difference was that the surface coating was now enriched with fluoride and the total thickness of the coating had increased to 1000 A. This indicates that the fluoride-containing layer was 800 A thick. Further analysis of the Auger spectrum showed that the aluminum was chemically bound to the oxygen, or fluorine, or perhaps to both of them.

The final surface examination technique (and the only one used to study the surface of the powder of this invention instead of foil) was photoelectron ESCA. This data is not completely analyzed at this time but does indicate that a large amount of $AlF_3$ is present in the outer 100A of particles. This was a bit surprising as it was thought that the oxide layer was at least 60–80 A thick. Apparently, since there is a large quantity of AlF contained within the upper 100 A of the coating, the $Al_2O_3$ layer must be thinner than was previously supposed.

The power of this invention and its untreated counterpart were studied on a hot stage microscope to determine whether any differences in behavior would exist, specifically with regard to agglomeration. The sample were heated at a rate of 250° C per minute to a maximum temperature of 800° C and under a flowing argon atmosphere so that the formation of oxide shells would be minimized and agglomeration (if there were to be any) would be enhanced. it was found by S. E. C. examination of 6 micron sized powders that extensive agglomeration took place in the untreated powder while little or no agglomeration could be observed in the powder sample of the invention. The same trend was found in some 27 micron aluminum powder although some agglomeration is present even in the samples of the invention. It should be noted that the agglomerates do become smaller as the conversion level of the invention is increased.

This qualitative data leads to the conclusion that the $AlF_3$ layer (subl. 1291° C) lying underneath the $Al_2O_3$ protective coating on the treated powder is providing better protection from agglomeration than is the unaltered oxide coating which is present on the untreated aluminum.

Single particle combustion studies with 44–53 micron aluminum particles showed that the treatment of this invention results in a 15% reduction in ignition delay time and a 28% decrease in burn time. This data (Table I) agrees quite favorably with the 20–30% burn rate enhancement that is typical with AFCAM propellants.

TABLE I

| | IGNITION DELAY TIME, MSEC | BURN TIME, MSEC |
|---|---|---|
| UNTREATED ALUMINUM POWDER | 6.525[1] | 15.58[3] |
| HF TREATED POWDER OF THE INVENTION | 5.543[2] | 11.19[4] |

[1] Average of 8 Tests
[2] Average of 21 Tests
[3] Average of 6 Tests
[4] Average of 10 Tests The magnitude of the burn rate enhancement which results from the treatment of this invention appears to increase as the particle size of the aluminum powder decreases. This data (for Mixes 209, 210, 251, 253, 268, 269, 252, and 255) is presented in Table II.

TABLE II

BURN RATE ENHANCEMENT VS ALUMINUM PARTICLE SIZE

| Mix NUMBER[1] | ALUMINUM SIZE (MICRONS), TYPE | BURN RATE AT 1000 PSIC, IN/SEC | % BURN RATE INCREASE |
|---|---|---|---|
| M-209 | 6, Untreated | 0.53 | — |
| M-210 | 6, AFCAM | 0.69 | 30 |
| M-251 | 60 Untreated | 0.53 | — |
| M-253 | 60, AFCAM | 0.59 | 11 |
| M-268 | 75, Untreated | 0.55 | — |
| M-269 | 75, AFCAM | 0.60 | 9 |
| M-252 | 100, Untreated | 0.53 | — |
| M-255 | 100, AFCAM | 0.53 | No increase |

[1] 90% solids composition with 24.8% 6 micron AP, 20.4% 25 micron AP, and 24.8% 200 micron AP.

In light of the fact that some metal fluorides are burn rate catalysts and in light of the fact that the process of this invention seems to produce an AlF coating on the aluminum particle surface, it might be expected that simply adding $AlF_3$ to a propellant composition would produce a burn rate increase. Such a composition was made and the burn rate of the baseline propellant (0.43 in/sec at 1000 psig) was depressed (0.37 in/sec at 1000 psig) when 2% $AlF_3$ was added.

From a consideration of the above, it can be seen that the hydrogen fluoride treatment of this invention provides an improvement in solid propellant ballistics by way of a mechanism which yields a more thorough and efficient combustion of aluminum metal. This phenomenon is most important in rocket motors with low residence time, and as a result, a low specific impulse motor efficiency will be observed. The use of the treated powder of this invention will make its motor residence time and the aluminum burn time comparable to give a better specific impulse motor efficiency.

Although the invention has been described with reference to specific embodiments, it should be understood to those skilled in the art that the invention is capable of a variety of alternative embodiments, and that all such embodiments as come within the scope of the appended claims are intended to be included herein.

What is claimed is:

1. A method for improving the combustibility of aluminum metal powders for use in solid rocket propellant formulations which comprises the step of exposing aluminum oxide coated aluminum metal powder, having a particle size smaller than about 100 microns to hydrogen fluoride gas for a period of time sufficient to effect a reaction therebetween.

2. A method for improving the combustibility of aluminum metal powders for use in solid rocket propellant formulations which comprises the steps of (a) exposing particles of an aluminum oxide coated aluminum metal powder smaller than about 100 microns to flowing hydrogen fluoride gas to effect an exothermic reaction therebetween; (b) continuing said reaction for a period of time sufficient to effect a replacement of said aluminum oxide coating with an aluminum fluoride coating; and (c) removing the resultant aluminum fluoride coated powder particles from said gas flow.

3. A method in accordnce with claim 2 wherein said particles are exposed to hydrogen fluoride gas at a temperature of about 25° C for a period of about 30 minutes.

* * * * *